US011282479B2

(12) United States Patent
Kajimoto et al.

(10) Patent No.: US 11,282,479 B2
(45) Date of Patent: Mar. 22, 2022

(54) DISPLAY CONTROL APPARATUS WITH DELAYED SWITCHING OF LUMINANCE AND CONTRAST BY FIRST AND SECOND MICROCOMPUTERS

(71) Applicant: DENSO TEN Limited, Kobe (JP)

(72) Inventors: Nobuaki Kajimoto, Kobe (JP); Tsukasa Ninomiya, Kobe (JP)

(73) Assignee: DENSO TEN Limited, Kobe (JP)

( * ) Notice: Subject to any disclaimer, the term of this patent is extended or adjusted under 35 U.S.C. 154(b) by 0 days.

(21) Appl. No.: 17/009,984

(22) Filed: Sep. 2, 2020

(65) Prior Publication Data

US 2021/0134247 A1 May 6, 2021

(30) Foreign Application Priority Data

Oct. 31, 2019 (JP) ..... 2019-198740

(51) Int. Cl.
*G09G 5/10* (2006.01)
*G09G 3/34* (2006.01)

(52) U.S. Cl.
CPC ..... *G09G 5/10* (2013.01); *G09G 3/3406* (2013.01); *G09G 2310/08* (2013.01); *G09G 2320/0247* (2013.01); *G09G 2320/064* (2013.01); *G09G 2320/066* (2013.01); *G09G 2320/103* (2013.01); *G09G 2360/144* (2013.01); *G09G 2380/10* (2013.01)

(58) Field of Classification Search
None
See application file for complete search history.

(56) References Cited

U.S. PATENT DOCUMENTS

2012/0098876 A1* 4/2012 Murai ..... G09G 3/3406 345/690
2013/0147857 A1* 6/2013 Kurikko ..... G09G 5/10 345/690
2017/0213523 A1* 7/2017 Liu ..... G09G 3/3406
2020/0168169 A1* 5/2020 Yoda ..... G09G 3/3648

FOREIGN PATENT DOCUMENTS

JP 02002014660 A * 1/2002
JP 2017-111288 A 6/2017

OTHER PUBLICATIONS

Espacenet translation of JP02002014660A (Year: 2002).*

* cited by examiner

*Primary Examiner* — Amr A Awad
*Assistant Examiner* — Donna V Bocar
(74) *Attorney, Agent, or Firm* — Oliff PLC

(57) ABSTRACT

A display control apparatus according to an embodiment includes a first microcomputer and a second microcomputer. The first microcomputer switches display luminance of a display. The second microcomputer switches contrast of the display. One of the first and second microcomputers delays switching according to switching of the other of the first and second microcomputers.

6 Claims, 4 Drawing Sheets

| DISPLAY MODE | FOR DAYTIME | | FOR NIGHTTIME | | ... |
|---|---|---|---|---|---|
| | DISPLAY LUMINANCE | CONTRAST | DISPLAY LUMINANCE | CONTRAST | |
| NAVIGATION | A11 | B11 | A21 | B21 | ... |
| CAMERA | A12 | B12 | A22 | B22 | ... |
| AUDIO | A13 | B13 | A23 | B23 | ... |
| SMARTPHONE LINKAGE | A14 | B14 | A24 | B24 | ... |
| ... | ... | ... | ... | ... | ... |

FIG. 3

DISPLAY CONTROL APPARATUS WITH DELAYED SWITCHING OF LUMINANCE AND CONTRAST BY FIRST AND SECOND MICROCOMPUTERS

BACKGROUND OF THE INVENTION

Field of the Invention

The invention relates to a display control apparatus and a switching method.

Description of the Background Art

Conventionally, there has been a display control apparatus that controls a display mode of a display. For example, when the display control apparatus switches an input source of a video that is displayed on the display, the display control apparatus adjusts display luminance to display luminance associated with the input source after switching (for example, refer to Japanese Unexamined Patent Publication No. 2017-111288).

In this type of the display control apparatus, for example, by switching the display luminance according to a timing of switching the input source, it is possible to reduce a screen flicker of the display.

However, in a conventional technology, switching of the display luminance and contrast has been controlled by a single microcomputer, and there has not been a technology that switches the display luminance and the contrast using separate microcomputers. Thus, when the display luminance and the contrast are controlled by the separate microcomputers, there has been a problem that the screen flicker described above may still occur.

SUMMARY OF THE INVENTION

According to one aspect of the invention, a display control apparatus includes a first microcomputer that switches display luminance of a display and a second microcomputer that switches contrast of the display. One of the first and second microcomputers delays switching according to switching of the other of the first and second microcomputers.

It is an object of the invention to provide a display control apparatus and a switching method capable of reducing a screen flicker.

These and other objects, features, aspects and advantages of the invention will become more apparent from the following detailed description of the invention when taken in conjunction with the accompanying drawings.

BRIEF DESCRIPTION OF THE DRAWINGS

FIG. 3 illustrates one example of mode information; and

DESCRIPTION OF THE EMBODIMENTS

A display control apparatus and a switching method according to an embodiment will now be described in detail with reference to the accompanying drawings. This invention is not limited to the embodiment described in the following.

Figure 1A:
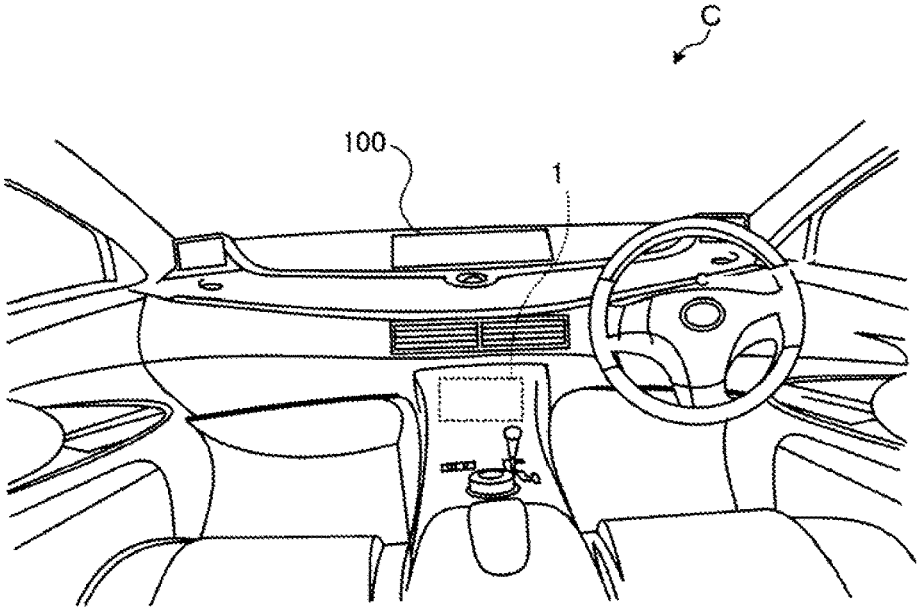
FIG. 1A illustrates a mounting example of a display control apparatus.
Figure 1B:
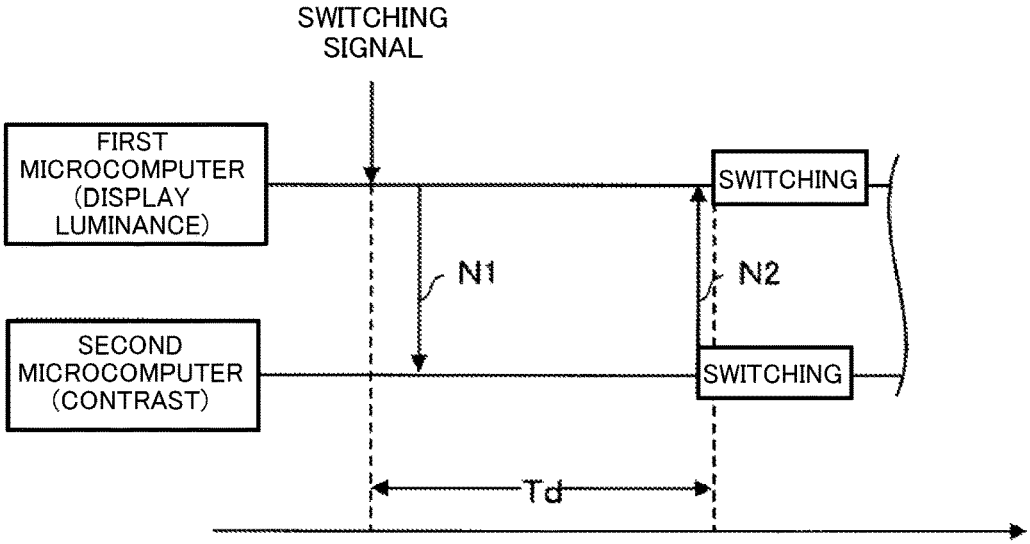
FIG. 1B illustrates an overview of a switching method.

First, an overview of the display control apparatus and the switching method according the embodiment will be described with reference to FIG. 1A and FIG. 1B. FIG. 1A illustrates a mounting example of the display control apparatus. FIG. 1B illustrates an overview of the switching method. The switching method is performed by a display control apparatus 1 illustrated in FIG. 1A.

As illustrated in FIG. 1A, the display control apparatus 1 according to the embodiment is, for example, mounted on a vehicle C and controls a display 100 mounted on the vehicle C. In an example shown in FIG. 1A, the display control apparatus 1 is installed in an interior of an instrument panel of the vehicle C and the display 100 is installed on the instrument panel.

The display 100 displays, for example, an output video of AV equipment and a navigation device installed in the vehicle C and a camera video of a camera that captures an image around the vehicle C.

The display 100 switches the display luminance and the contrast according to a signal that is input from the display control apparatus 1. In this case, when switching the display luminance and the contrast at different timings, a screen flicker occurs so that the display luminance and the contrast are preferably switched at a substantially same timing.

For example, in a conventional technology, since the display luminance and the contrast are controlled by a single microcomputer, it is possible to easily match a switching timing of the display luminance and a switching timing of the contrast.

On the other hand, the display control apparatus 1 according to the embodiment, as described below, controls the display luminance and the contrast using respective different microcomputers. In such a configuration, it is not easy to match the switching timing of the display luminance and the switching timing of the contrast.

Furthermore, the display control apparatus 1 has respective different operating systems (OS) for a first microcomputer that controls the display luminance and a second microcomputer that controls the contrast. Specifically, a real time OS is mounted on the first microcomputer that controls the display luminance and Linux OS (a registered trademark) is mounted on the second microcomputer that controls the contrast.

The first microcomputer immediately switches the display luminance to sequentially perform a task whose priority is high while the second microcomputer, in some cases, does not immediately switches the contrast, for example, in a case of switching the contrast after end of the task being performed at present.

Thus, the display control apparatus 1 according to the embodiment switches the display luminance using the first microcomputer after waiting for switching of the contrast by the second microcomputer. Specifically, as illustrated in FIG. 1B, when the first microcomputer acquires a switching signal that triggers the display luminance and the contrast to switch, the first microcomputer notifies an acquisition notification N1 indicating acquisition of the switching signal to the second microcomputer. In this case, the first microcomputer does not perform switching of the display luminance at a timing of acquiring the switching signal and stands by. Here, the meaning of "stands by" includes performing other tasks.

When the second microcomputer acquires the acquisition notification N1 from the first microcomputer, the second microcomputer prepares the switching of the contrast based on the acquisition notification N1. As one example of preparation for the switching of the contrast, a task that should be performed before the switching of the contrast is ended.

Then, the second microcomputer notifies a switching notification N2 indicating performance of the switching of the contrast at a timing of starting the switching of the contrast to the first microcomputer and performs the switching of the contrast.

The first microcomputer performs the switching of the display luminance after receiving the switching notification N2. That is, the first microcomputer delays the switching of the display luminance by a delay time Td after acquiring the switching signal, and actually performs the switching of the display luminance.

Thus, it is possible to substantially match the switching timing of the display luminance and the switching timing of the contrast in the display 100. Therefore, according to the display control apparatus 1 according to the embodiment, even if the display luminance and the contrast are controlled by the respective different microcomputers, it is possible to reduce the screen flicker.

A time difference between the switching timing of the display luminance and the switching timing of the contrast may be within a predetermined error range. It is preferable that the switching of the contrast be performed prior to the switching of the display luminance.

As a result, for example, the second microcomputer may notify the switching notification N2 to the first microcomputer after completion of the switching of the contrast. Alternatively, the second microcomputer may notify the switching notification N2 to the first microcomputer during the switching of the contrast.

Figure 2:
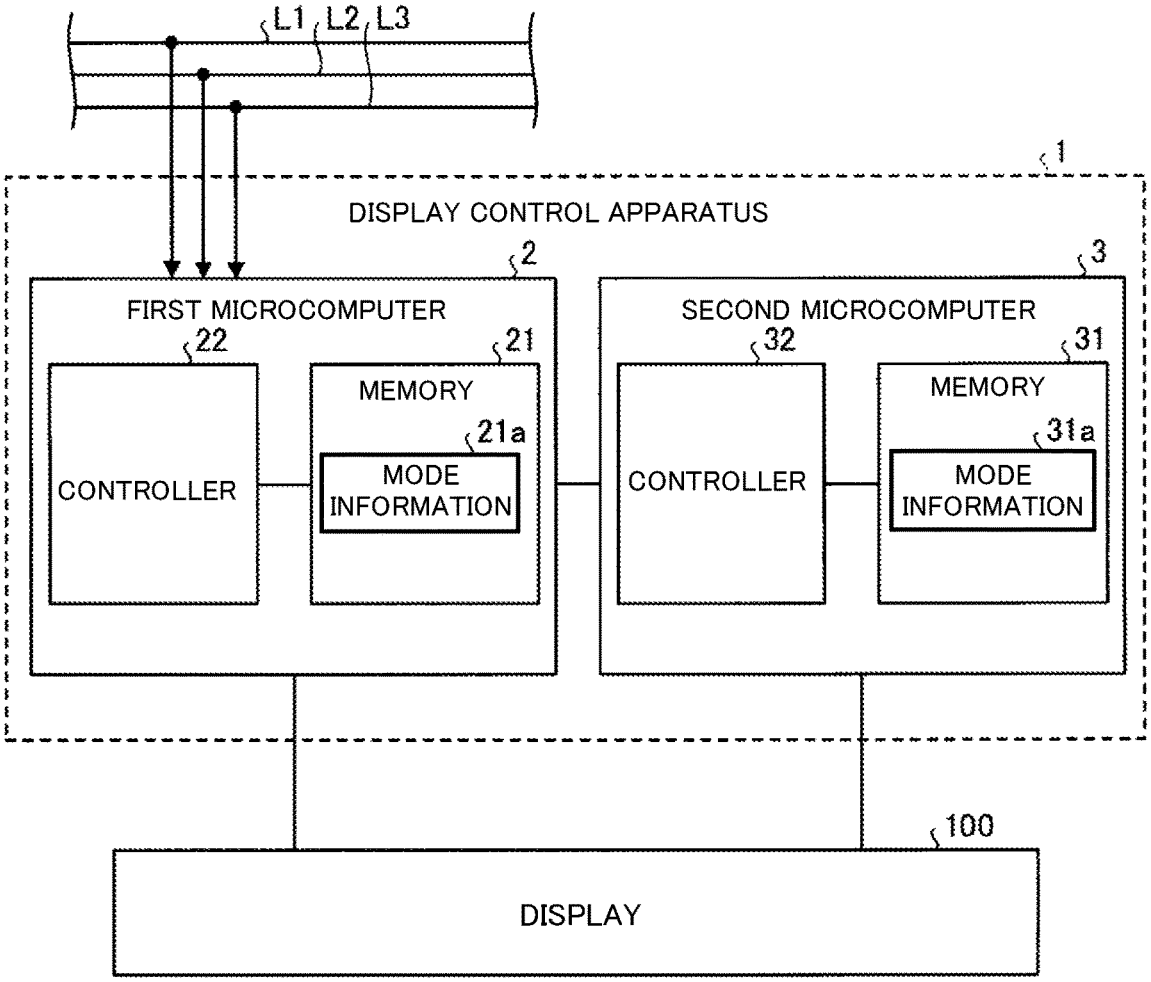
FIG. 2 is a block diagram of the display control apparatus.

Next, a configuration example of the display control apparatus 1 according to the embodiment will be described with reference to FIG. 2. FIG. 2 is a block diagram of the display control apparatus 1. FIG. 2 also illustrates a display 100.

First, the display 100 will be described. The display 100 is a display such as a liquid crystal display. The display 100 switches the display luminance by causing a backlight to emit based on a PWM (Pulse Width Modulation) signal that is input from the display control apparatus 1. Furthermore, the display 100 switches the contrast by switching a light diffusion rate of the backlight according to a control signal that is input by the display control apparatus 1.

Subsequently, the display control apparatus 1 will be described. As illustrated in FIG. 2, the display control apparatus 1 includes a first microcomputer 2 and a second microcomputer 3. The first microcomputer 2 includes a memory 21 and a controller 22. The second microcomputer 3 includes a memory 31 and a controller 32.

The memory 21 is, for example, implemented by semiconductor memory elements such as a RAM (Random Access Memory) and a flash memory, or storage devices such as a hard disk and an optical disk. In an example shown in FIG. 2, the memory 21 stores mode information 21*a*.

For example, the mode information 21*a* relates to the display luminance and the contrast for each display mode. FIG. 3 illustrates one example of the mode information 21*a*. As illustrated in FIG. 3, in the mode information 21*a*, the "display mode", the "display luminance" and the "contrast", and the like, are mutually associated.

The "display mode" indicates an input source of a video that is displayed on the display 100. FIG. 3 shows an example in which the display mode includes a navigation, a camera, an audio, a smartphone linkage, and the like. The smartphone linkage is a mode in which a video input from a smartphone of a user is displayed.

The "display luminance" indicates the display luminance of the video in the corresponding display mode. The "contrast" indicates the contrast of the video in the corresponding display mode. As illustrated in FIG. 3, each of the "display luminance" and the "contrast" has values "for daytime and nighttime".

Here, the values "for daytime" indicate that a periphery of the vehicle C is sufficiently bright and the values "for nighttime" indicate that the periphery of the vehicle C is dark. As described below, in the display control apparatus 1, the values "for daytime" and the values "for nighttime" are switched by turning on/off a headlight or based on a measurement result of an illuminometer that measures illuminance outside the vehicle C.

Each of the display luminance and the contrast shown in FIG. 3 is an optimized value for each corresponding display mode. Thus, by switching the display luminance and the contrast for each display mode, it is possible to display the video with the optimal display luminance and contrast in each display mode.

Each of the display luminance and the contrast in each display mode shown in FIG. 3 may be a default value or may be appropriately changed from the default value by a user.

Referring back to FIG. 2, the controller 22 will be described. The controller 22, for example, a CPU, an MPU, or the like, uses the RAM as a work area to execute various programs stored in the memory 21. The controller 22 is implemented by executing these programs. The controller 22 is, for example, implemented by an integrated circuit such as an ASIC, an FPGA, or the like.

The controller 22 performs a simple drawing process in addition to the switching of the display luminance of the display 100. For example, drawing of a logo at a start-up of the display is taken as one example of the simple drawing process.

The controller 22 acquires switching signals that are respectively input from a first signal line L1, a second signal line L2 and a third signal line L3. For example, the first signal line L1 is a signal line for inputting an illuminance signal indicating a detection result of the illuminometer to the first microcomputer 2. The second signal line L2 is a signal line for inputting a lighting signal indicating a presence or absence of lighting of the headlight to the first microcomputer 2.

The illuminance signal and the lighting signal are one example of signals relating to the illuminance and are high or low signals. Specifically, when the illuminance that is measured by the illuminometer is a predetermined value or lower, the illuminance signal becomes "high", and while the headlight is turned on, the lighting signal becomes "high".

The third signal line L3 is a signal line for inputting a CAN (Controller Area Network) signal to the first microcomputer 2. For example, the controller 22 acquires a reverse signal indicating that a shift lever of the vehicle C has been reversed.

The controller 22 acquires the illuminance signal, the lighting signal and the reverse signal as the switching signal. When the controller 22 acquires the switching signal, the controller 22 notifies an acquisition notification including types of the acquired switching signals to the second microcomputer 3.

Then, the controller 22 switches the display luminance of the display 100 after waiting for a switching notification that is input from the second microcomputer 3.

For example, when the controller 22 acquires the illuminance signal and the lighting signal, the controller 22 switches the display luminance for daytime to the display luminance for nighttime, and when the illuminance signal and the lighting signal become low, the controller 22 switches the display luminance for nighttime to the display luminance for daytime.

Here, the display luminance for nighttime is preferably higher than the display luminance for daytime. Thus, it is possible to improve visibility of the display 100 according to the illuminance around the vehicle C.

When the reverse signal is input to the controller 22, that is, when the vehicle C travels backward, the camera video is displayed on the display 100. Thus, the controller 22 refers to the mode information 21*a* and switches the display luminance to the display luminance in the "camera" display mode. Furthermore, when the controller 22 has acquired various types of the switching signals that are input when switching the display mode, the controller 22 switches the display luminance by performing the same processing described above.

Subsequently, the second microcomputer 3 will be described. The second microcomputer 3 controls the contrast of the display 100. For example, the second microcomputer 3 performs a drawing process of a display image that is displayed on the display 100, and the like, in addition to control of the contrast.

As illustrated in FIG. 2, the second microcomputer 3 includes the memory 31 and the controller 32. The memory 31 is, for example, implemented by semiconductor memory elements such as a RAM (Random Access Memory) and a flash memory, or storage devices such as a hard disk and an optical disk in the same way as the memory 21. In an example shown in FIG. 2, the memory 31 stores mode information 31*a*. The mode information 31*a* is the same information as the mode information 21*a*. Thus, a description here will be omitted.

The controller 32, for example, a CPU, an MPU, or the like, uses the RAM as a work area to execute various programs stored in the memory 21. The controller 32 is implemented by executing these programs. The controller 32 is, for example, implemented by an integrated circuit such as an ASIC, an FPGA, or the like.

The controller 32 switches the contrast of the display 100 based on the acquisition notification that is acquired from the first microcomputer 2. Specifically, the controller 32 refers to the mode information 31*a* and switches the contrast to the contrast in the display mode specified by the switching notification.

Similarly, when the controller 32, even in the same display mode, switches the contrast between the contrast for daytime and night time, the controller 32 switches the contrast to the corresponding contrast.

Furthermore, when the controller 32 switches the contrast, the controller 32 notifies the switching notification to the first microcomputer 2. Thus, the first microcomputer 2 switches the display luminance according to a timing of the switching of the contrast performed by the second microcomputer 3.

In other words, it is possible to switch the display luminance and the contrast at the substantially same timing. Therefore, in the display control apparatus 1 according to the embodiment, it is possible to prevent the screen flicker. As described above, it is preferable that the display luminance and the contrast are switched at the same timing. However, even when the display luminance and the contrast are switched at substantially the same timing, a user does not visually feel the screen flicker.

Thus, the switching timing of the display luminance and the switching timing of the contrast are not necessarily matched. If the time difference between the switching timing of the display luminance and the switching timing of the contrast is within the predetermined error range, it is possible to appropriately change a timing of notifying the switching notification N2 by the second microcomputer 3.

Figure 4:
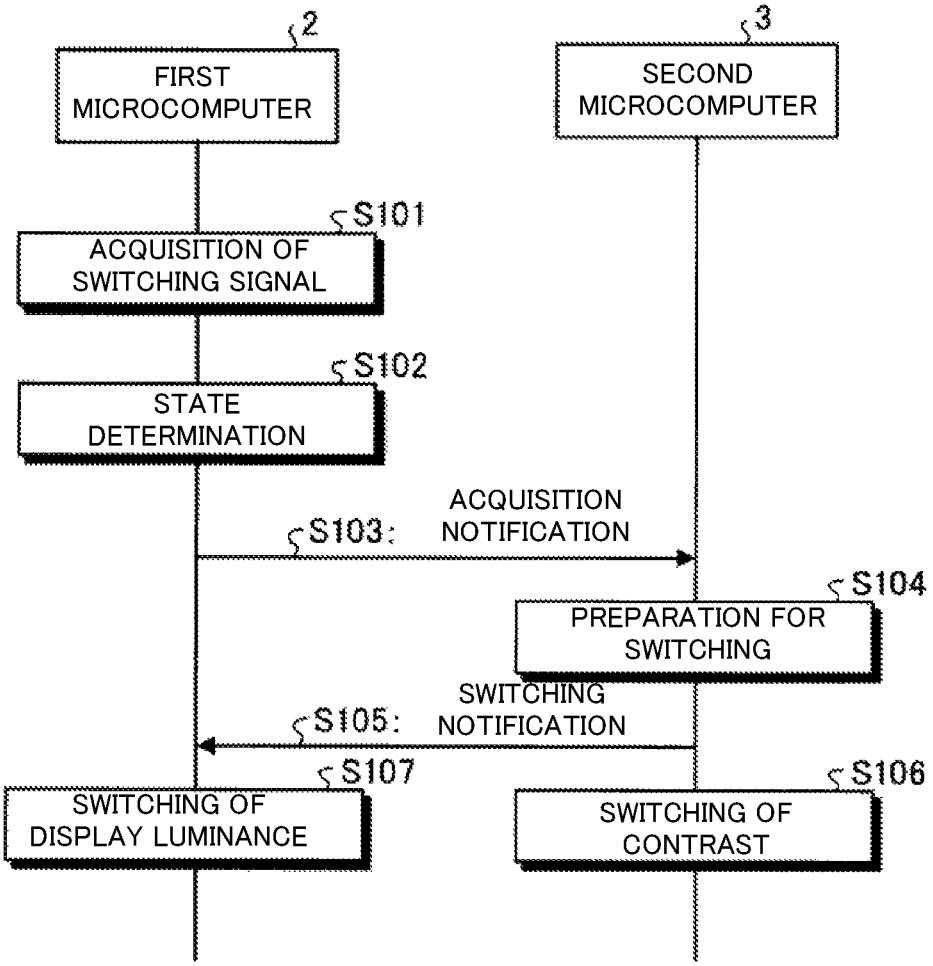
FIG. 4 is a timing chart illustrating a processing procedure executed by the display control apparatus.

Next, a processing procedure executed by the display control apparatus 1 according to the embodiment will be described with reference to FIG. 4. FIG. 4 is a timing chart illustrating the processing procedure executed by the display control apparatus 1. The processing procedure shown below is repeatedly executed by the controller 22 of the first microcomputer 2 and the controller 32 of the second microcomputer 3 for each acquisition of the switching signal.

As illustrated in FIG. 4, when the first microcomputer 2 acquires the switching signal (a step S101), the first microcomputer 2 performs a state determination (a step S102). Here, the state determination includes a determination whether or not the switching of the display mode is necessary, and a determination whether or not the switching between the values for daytime and nighttime is necessary. That is, the state determination here is a process of determining whether or not the switching of the display luminance and the contrast is necessary.

Subsequently, when the first microcomputer 2 notifies the acquisition notification N1 indicating the acquisition of the switching signal to the second microcomputer 3 (a step S103), in the second microcomputer 3, the preparation for the switching of the contrast is started (a step S104).

Subsequently, the second microcomputer 3 notifies the switching notification N2 to the first microcomputer 2 at a timing at which the preparation for the switching of the contrast has completed (a step S105), performs the switching of the contrast (a step S106) and ends the process.

The first microcomputer 2 performs the switching of the display luminance after receiving the switching notification that is input from the second microcomputer 3 (a step S107) and ends the process.

As described above, the display control apparatus 1 according to the embodiment includes the first microcomputer 2 and the second microcomputer 3. The first microcomputer 2 switches the display luminance of the display 100. The second microcomputer 3 switches the contrast of the display 100. The first microcomputer 2 (one example of one microcomputer) delays the switching according to the switching of the second microcomputer 3 (one example of the other microcomputer). Therefore, the display control apparatus 1 according to the embodiment reduces the screen flicker.

By the way, in the embodiment described above, a case in which the first microcomputer 2 delays the switching of the display luminance according to the switching of the second microcomputer 3 (i.e., the first microcomputer 2 is used as one microcomputer and the second microcomputer 3 is used as the other microcomputer) has been described. However, the invention is not limited thereto.

Specifically, one microcomputer may be used as the second microcomputer 3 and the other microcomputer may be used as the first microcomputer 2. In this case, when a difference between the display luminance before and after the switching by the first microcomputer 2 is compared with a difference between the contrast before and after the switching by the second microcomputer 3, the one of the first microcomputer 2 and the second microcomputer 3 preferably delays the switching of one of the display luminance and the contrast whose difference is larger.

That is, one of the display luminance and the contrast which has less effect on appearance is first switched, and the other one which has more effect on appearance is later switched, so that a user does not visually feel the screen flicker.

For example, when the display luminance is first switched, after the second microcomputer 3 has acquired the acquisition notification N1, the second microcomputer 3 may notify the switching notification N2 to the first microcomputer 2 prior to the switching of the contrast.

Furthermore, it may be configured that the switching signal is input to the second microcomputer 3, and the second microcomputer 3 may acquire the switching signal and output the switching notification to the first microcomputer 2 at the timing at which the preparation for the switching of the contrast has completed. It is needless to say that the switching signal may be input to each of the first microcomputer 2 and the second microcomputer 3.

In the example described above, the switching of the display mode and the switching between the values for daytime and nighttime of each of the display luminance and the contrast have been described. However, the invention is not limited thereto. That is, the invention may also be applied in an image quality adjustment screen in each display mode.

It is possible for a person skilled in the art to easily come up with more effects and modifications. Thus, a broader modification of this invention is not limited to specific description and typical embodiments described and expressed above. Therefore, various modifications are possible without departing from the general spirit and scope of the invention defined by claims attached and equivalents thereof.

While the invention has been shown and described in detail, the foregoing description is in all aspects illustrative and not restrictive. It is therefore understood that numerous other modifications and variations can be devised without departing from the scope of the invention.

What is claimed is:

1. A display control apparatus comprising:

a first microcomputer that switches display luminance of a display; and a second microcomputer that switches contrast of the display, wherein the first microcomputer delays switching of the display luminance of the display at least until after the second microcomputer begins to start switching the contrast of the display, and further wherein (i) the first microcomputer outputs, after receiving a switching signal that triggers the display luminance and the contrast to switch, an acquisition notification to the second microcomputer, (ii) the second microcomputer, after receiving the acquisition notification, starts switching the contrast of the display and outputs a switching notification to the first microcomputer indicating that the second microcomputer performs the switching of the contrast, and (iii) the first microcomputer switches the display luminance after receiving the switching notification from the second microcomputer.

2. The display control apparatus according to claim 1, wherein the switching signal acquired by the first microcomputer is a signal relating to illuminance around a vehicle or a signal relating to switching of an input source of a video that is displayed on the display.

3. A display control apparatus comprising:

a first microcomputer that switches display luminance of a display; and a second microcomputer that switches contrast of the display, wherein one of the first and second microcomputers delays switching according to switching of the other of the first and second microcomputers, and when a difference between the display luminance before and after the switching by the first microcomputer is compared with a difference between the contrast before and after the switching by the second microcomputer, the one of the first and second microcomputers delays the switching of one of the display luminance and the contrast whose difference is larger.

4. A switching method comprising the steps of:

(a) using a first microcomputer to switch display luminance of a display and a second microcomputer to switch contrast of the display; and (b) delaying switching of the display luminance by the first microcomputer at least until after the second microcomputer begins to start switching the contrast of the display, wherein (i) the first microcomputer outputs, after receiving a switching signal that triggers the display luminance and the contrast to switch, an acquisition notification to the second microcomputer, (ii) the second microcomputer, after receiving the acquisition notification, starts switching the contrast of the display and outputs a switching notification to the first microcomputer indicating that the second microcomputer performs the switching of the contrast, and (iii) the first microcomputer switches the display luminance after receiving the switching notification from the second microcomputer.

5. The method according to claim 4, wherein the switching signal acquired by the first microcomputer is a signal relating to illuminance around a vehicle or a signal relating to switching of an input source of a video that is displayed on the display.

6. A switching method comprising the steps of:

(a) using a first microcomputer to switch display luminance of a display and a second microcomputer to switch contrast of the display; and (b) delaying switching by one of the first and second microcomputers according to switching of the other of the first and second microcomputers, wherein when a difference between the display luminance before and after the switching by the first microcomputer is compared with a difference between the contrast before and after the switching by the second microcomputer, the one of the first and second microcomputers switches one of the display luminance and the contrast whose difference is larger.

* * * * *